US007404772B2

(12) United States Patent
Koide et al.

(10) Patent No.: US 7,404,772 B2
(45) Date of Patent: Jul. 29, 2008

(54) GOLF PUTTER

(75) Inventors: Hiroichi Koide, Sanjo (JP); Tsuneo Nakamura, Niigata (JP); Shinichi Yamamura, Nagoya (JP)

(73) Assignee: Niigata TLO Corporation, Niigata-shi (JP)

( * ) Notice: Subject to any disclaimer, the term of this patent is extended or adjusted under 35 U.S.C. 154(b) by 0 days.

(21) Appl. No.: 10/580,846

(22) PCT Filed: Mar. 24, 2006

(86) PCT No.: PCT/JP2006/306025

§ 371 (c)(1),
(2), (4) Date: Aug. 30, 2006

(87) PCT Pub. No.: WO2007/023591

PCT Pub. Date: Mar. 1, 2007

(65) Prior Publication Data

US 2007/0225085 A1 Sep. 27, 2007

(30) Foreign Application Priority Data

Aug. 24, 2005 (JP) ..... 2005-242136

(51) Int. Cl.
*A63B 53/04* (2006.01)
*A63B 53/06* (2006.01)

(52) U.S. Cl. ..... 473/334; 473/340

(58) Field of Classification Search ..... None
See application file for complete search history.

(56) References Cited

U.S. PATENT DOCUMENTS 7,147,573 B2 * 12/2006 DiMarco ..... 473/324
7,166,041 B2 * 1/2007 Evans ..... 473/334

FOREIGN PATENT DOCUMENTS

JP 3-109501 U 11/1991
JP 4-347179 A 12/1992
JP 6-238022 8/1994

* cited by examiner

*Primary Examiner*—Alvin A Hunter
(74) *Attorney, Agent, or Firm*—Kubovcik & Kubovcik

(57) ABSTRACT

The ring shape guide 9 and a thin plate shaped retention body 10 project from the back face 5 of a putter head, and the weight 11 is movably retained along the guide 9, by pressing the guide 9 and the retention body 10 in the vertical direction, through a concave slot provided in the circumferential direction of the disk shape weight 11.

2 Claims, 6 Drawing Sheets

Prior Art

LF PUTTER

BACKGROUND OF THE INVENTION

1. Field of the Invention

The present invention concerns a golf putter and more particularly a golf putter, in which the weight and center of gravity of the putter head is adjustable.

2. Description of the Related Art

Putting in golf is where the player hits the ball on a green toward a cup (hole) with a golf putter (called "putter" hereinafter), which requires a subtle touch in order to secure the exact distance and direction on greens that can have different turf orientation and/or undulation.

With putters, various factors come into transmitting exact subtle force adjustments of the player to the ball and especially with the head, it is said that the weight, position of the center of gravity, shape and hardness of the face are all important factors.

Of these factors, the weight and position of the center of gravity are said to be particularly important, because the former has a large impact on the driving force of balls and the latter on torsion resistance and the stroke orbit during impact.

However, individual players must make adjustments for the feel of the weight and center of gravity of a head 93 of an ordinary putter 90 as shown in FIG. 10, because they are set presupposing they are for use by the average player.

For instance, of well-known adjustment methods, a method exists where a weight such as a plumb plate or plumb tape is fixed to an area of a head 93, apart from a face 94, such as a tail 97 or a back 98.

Also, with regard to inventions concerning adjustment method, there has been proposed a method of adjustment, in which a weight is moved at will along a slot provided in the putter head (refer to Patent Document 1).

As shown in FIG. 11, this invention consists of adjusting the center of gravity of a head 100 by a moving weight 103 that has been inserted from a weight insertion port 102 and along a slide slot 101 provided in the bottom rear of the head 100 and then fixing it in place in the appropriate position.

However, in the aforementioned method of attaching a plumb plate or tape, the range of adjustment is too limited because the mass of the plumb plate, for example, is too small compared to that of the head. In addition, they can come off during play, and hence violate the rule prescribing that club performance must remain unchanged throughout play.

With regard to the invention disclosed in Patent Document 1, not only the range of adjustment was too limited because the mass of the weight is smaller than that of the head but also the mass needs to be removed and fixed in place using a tool, thus preventing subtle adjustments to be easily carried out.

Patent Document 1: Publication of Registered Utility Model No. 3109501

SUMMARY OF THE INVENTION

The objective of the present invention is to provide a putter that allows for a larger range of subtle adjustment of the heads weight and position of center of gravity.

The present invention aims at attaining that objective by providing a golf putter with a head at one end of a shaft and a grip at the other end, and in which the head is provided with a guide that has a bar projecting from the back in a ring shape or U shape basically parallel to the horizontal plane and has a retained weight that is movable along the guide and with a means of fixing the weight in any position.

Here, the back of the head corresponds to the face opposite the face that hits the ball.

Besides the aforementioned, the present invention concerns the golf putter in claim 1 that is composed of being capable of moving the center position of the weight along the guide on the same circumference around a reference point.

Moreover, the present invention is a golf putter in which the fixation means comprises a female screw hole provided in the weight with a male screw to engage with the female screw hole, and with the head of the male screw having a slot that engages with the thickness of a coin.

It should be noted that, herein, the coin designated is for instance the coins currently in use.

According to the present invention, as the weight can be moved and easily fixed in place along the guide provided on the back of the head, a golf putter that allows for quite a range of subtle adjustment of the heads weight and center of gravity, depending on the individual player, can be provided.

DETAILED DESCRIPTION OF THE INVENTION

Now, embodiments of the present invention shall be described with reference to the drawings.

Figure 1:
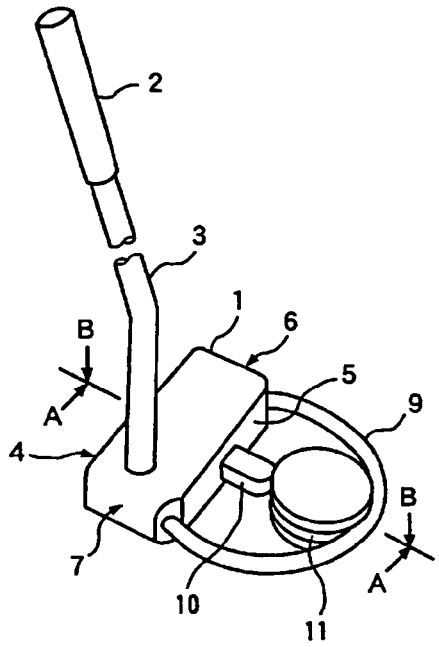
FIG. 1 is a perspective view of a first embodiment of a putter according to the present invention.

A putter according to a first embodiment of the present invention is shown in FIG. 1. FIG. 1 is a perspective view showing the structure of the first embodiment.

The head 1 is connected with a grip 2 via a shaft, with the longitudinal end face of the head 1 body being provided with a face 4 for hitting the ball.

A ring shape guide 9 in proximity to a toe 6 and a heel 7 of the head 1 projects from a back face 5, the opposite face 4, basically parallel to the horizontal plane. Also, a thin plate shaped retention body 10 projects from the center of the back face 5 on the same plane as the guide 9.

A gap of constant width is formed between the guide 9 and the retention body 10, and a disk shape weight 11 is retained but is movable so as to be sandwiched between them.

Figure 2:
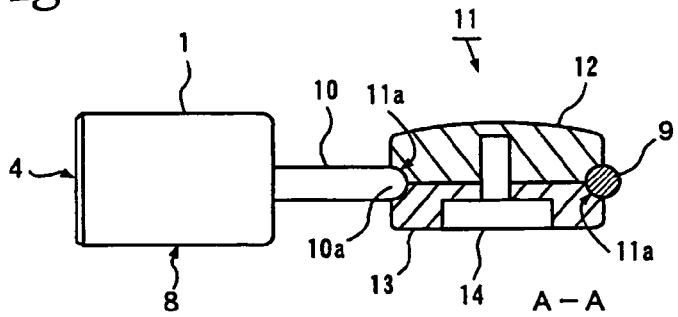
FIG. 2 is a partial cross section view along A-A as shown in FIG. 1.

FIG. 2 shows a cross section view of the putter head. FIG. 2 shows a partial cross section view along A-A as shown in FIG. 1.

The weight 11 is retained by engaging with a concave slot 11*a* provided across the outer periphery thereof in a tip section 10*a* of the retention body 10 and the guide 9.

This weight 11 is composed of an upper weight 12, an lower weight 13 and a fixing screw 14 which is a fixation means.

Figure 3:
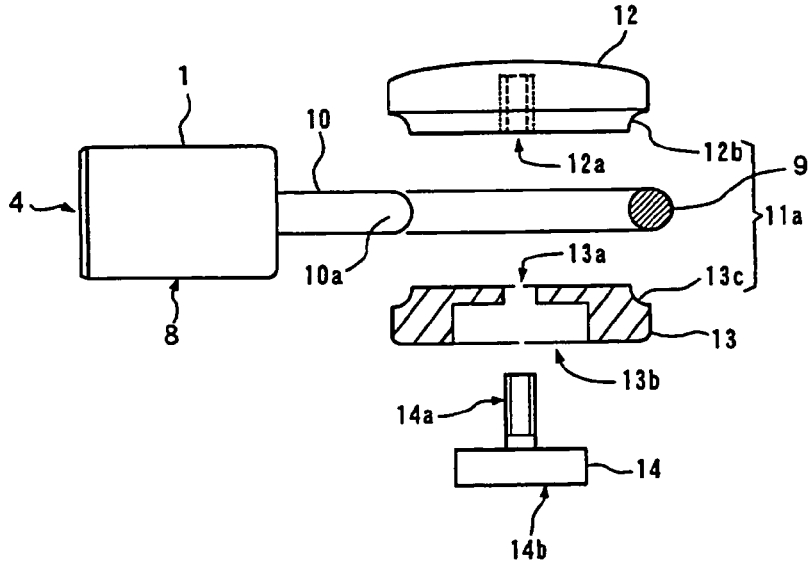
FIG. 3 is an assembly drawing showing the structure of the weight via a partial cross section view.

The assembly drawing is shown in FIG. 3. FIG. 3 shows a partial cross section view of the same position as FIG. 2.

A screw hole 12*a* is provided in the bottom center of the upper weight 12 and a through hole 13*a* at the center of the lower weight 13; the upper weight 12 and the lower weight 13 are connected to compose the weight, by a screwing fixing screw 14 having a screw section 14*a* engaging with a screw hole 12*a* in the screw hole 12*a* via a through hole 13*a* from the under lower weight 13.

Consequently on this connection, a curve section 12*b* of the lower end outer periphery of the upper weight 12 and a curve section 13*c* of the upper end outer periphery of the lower weight 13 form the concave slot 1*a*, and the weight 11 is capable of being retained and fixed in place by pressing vertically the guide 9 and the tip section 10*a* of the retention body so as to insert.

Besides the aforementioned, as a recess 13*b* fitting with a head 14*b* of a fixing screw 14 is provided in the bottom of the lower weight 13, the bottom of the weight 11 after the connection will have a smooth surface.

Figure 4:
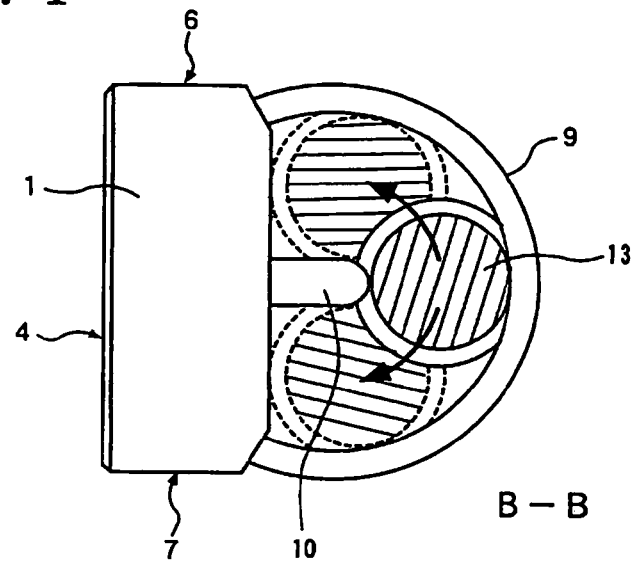
FIG. 4 is a partial cross section view along B-B as shown in FIG. 1.

The cross section view of the head in the plane direction shall be shown in FIG. 4. FIG. 4 is a partial cross section view along B-B of the head as shown in FIG. 1.

The weight 11 can move at will in the direction shown by an arrow in the drawing along the inner periphery of the guide 9, because the pressure of the upper weight 12 and the lower weight 13 on the guide 9 and the tip section 10*a* of the retention body can be reduced, by unscrewing the fixing screw 14 conveniently within a range not to separate the upper weight 12 and the lower weight 13.

After moving the weight 11 to any position, the weight 11 can be fixed in place by screwing again the fixing screw 14.

Figure 5:
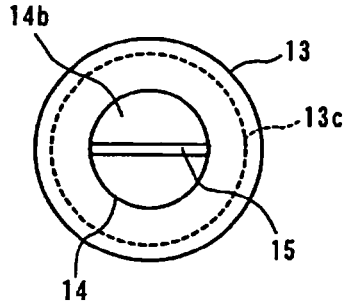
FIG. 5 is a bottom view of the weight.

FIG. 5 shows a bottom view of the weight.

A slot 15 having a width (about 2 mm) for fitting the ten-yen or hundred-yen coin currently in use, in the head 14*b* of this fixing screw 14, allowing for tightening the fixing screw 14 of the like simply and easily, by using these pieces instead of a screw driver.

Figure 6:
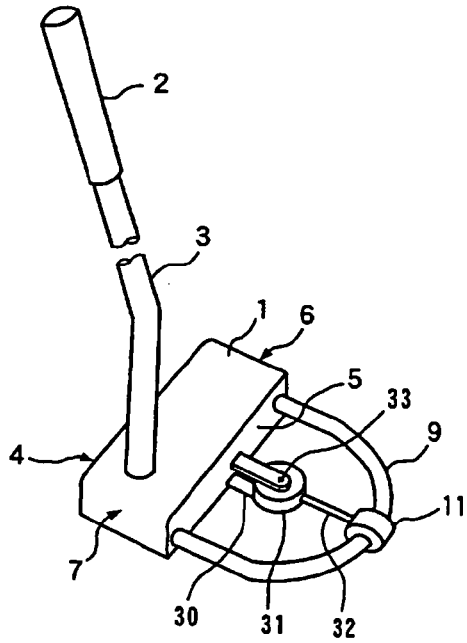
FIG. 6 is a perspective view of the second embodiment of a putter according to the present invention.

A putter according to the second embodiment of the present invention shall be shown in FIG. 6. FIG. 6 is a perspective view showing the structure of the second embodiment and the same parts as shown in FIG. 1 are referred to as the same symbols.

The U shape guide 9 in proximity to the toe 6 at one end and the heel 7 of the head 1 at the other end projects basically parallel to the horizontal plane. Also, two thin plates 30 are provided in the central portion of the back face 5 so to put a rotation axis 33 between tip sections thereof, and an oscillating cylinder 31 is attached to a rotation axis 9.

Also, the cylindrical weight 11 is attached movably to the guide 9 via a through hole.

This weight 11 and the cylinder 31 are connected with a bar shape body 22, and the weight 11 is composed of being capable of moving the curve portion thereof along the guide 9, in connection with the rotation of the cylinder 31.

It should be noted that a fixation means for fixing the weight 11 in any position, for instance, a fixation means composed of a screw hole from the weight 11 bottom to a through hole and a screw engaging with the same, is provided in the bottom weight 11.

The present embodiment, being simple in structure compared with the first embodiment, can be manufactured easily and handled simply.

Figure 7:
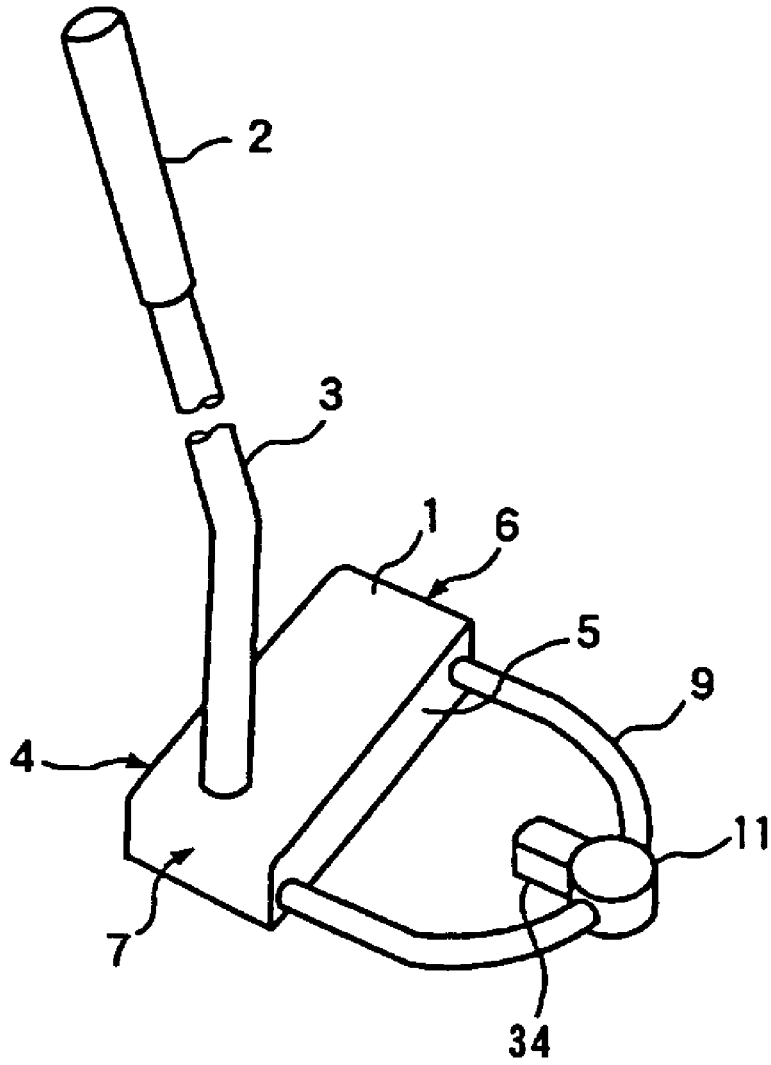
FIG. 7 is a perspective view of the third embodiment of a putter according to the present invention.

A putter according to the third embodiment of the present invention is shown in FIG. 7, and the same parts as FIG. 1 are referred to with the same symbol.

In the present embodiment, the structure concerning the guide 9 and the weight 11 is basically similar to the second embodiment; however it is characterized by the absence of a cylinder 21 and a bar shape body 21 and by that weight 11 can move alone.

To this weight 11, a balancer 23 for making adjustments for the balance is attached in the radial direction of the guide 9.

The present embodiment, being simple in structure compared with the second embodiment, can be manufactured more easily and handled simply.

Figure 8A:
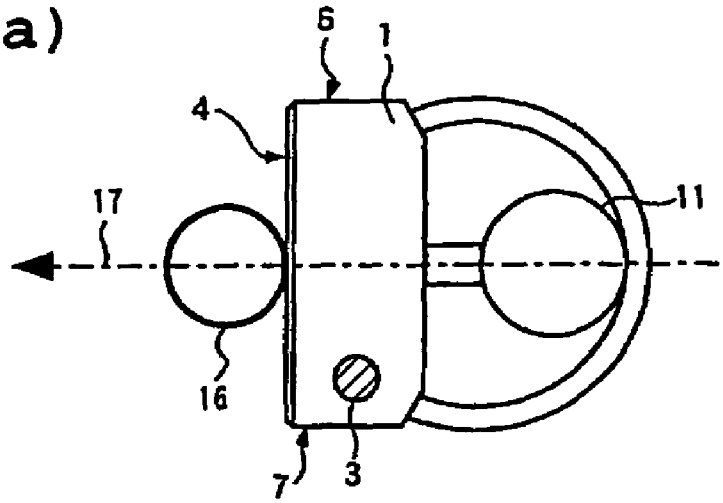
FIG. 8 describes how to use weight displacement, showing the case of (a) an ideal stroke, (b) a stroke that hooks the ball and (c) a stroke that slices the ball.
Figure 8B:
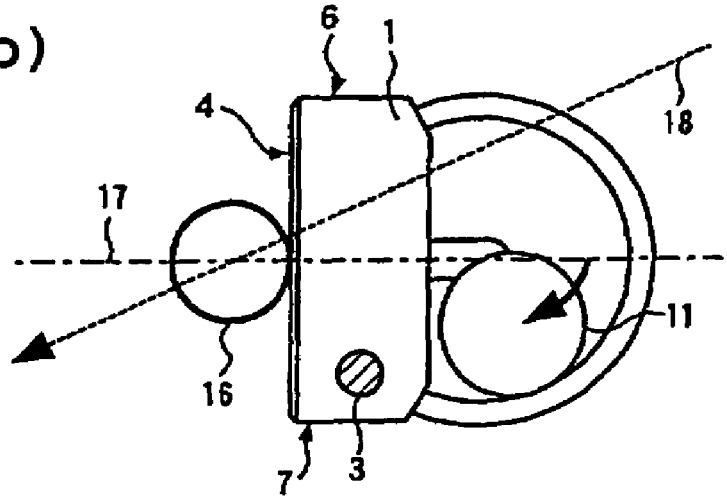
Figure 8C:
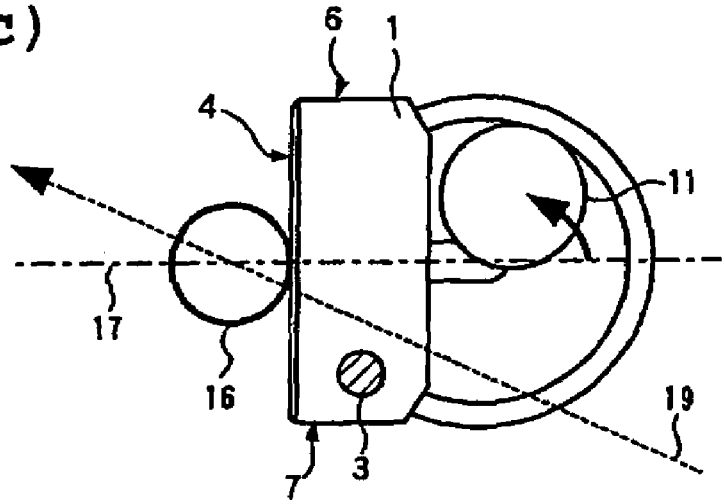

Now, the actual usage of embodiments of the putter according to the present invention described above shall be explained based on FIG. 8. FIG. 8 is a plane view showing a case of hitting a golf ball with the head.

It should be noted that the principle is same for the other embodiments, though an example of the first embodiment shall be described here.

In order to hit a golf ball 16 with the head 1 to drive the ball straight ahead, as shown in FIG. 8(*a*), it is ideal that the orbit of the stroke drawn the head be identical to the center line 17 connecting the center of the head 1 and the center of the golf ball 16.

For this effect, the take back should be performed in a direction along the center line 17, but the direction often deviated from the center line 17 depending on the skill of the player or the condition of the day.

There, in case where the player feels that the stroke orbit deviates to a direction 18 which causes the rotation that hooks the ball 16, they can start their stroke with a feeling that the take back is forced in a direction along the center line 17, by moving the weight 11 to a heel 7 side of the head 1, as shown in FIG. 8(*b*).

On the contrary, in case where they feel that the stroke orbit deviates to a direction 19 which causes the rotation that slices the ball 16, they can start their stroke with a feeling that the take back is forced similarly in the direction along the center line 17, by moving the weight 11 to the toe 6 side, as shown in FIG. 8(*c*).

It is desirable to allow the player making adjustments for the stroke by moving the weight gradually, through graduations or the like provided on the top of the weight 11, a retention ring 9 and so on.

Besides the aforementioned, in case of the head 1 according to the first embodiment, the weight and the vertical center of gravity of the head 1 may also be adjustable, by changing the total mass or mass distribution of the upper weight 12 and the lower weight 13.

As mentioned above, the putter is adjustable adjusted subtly according to each player.

Figure 9:
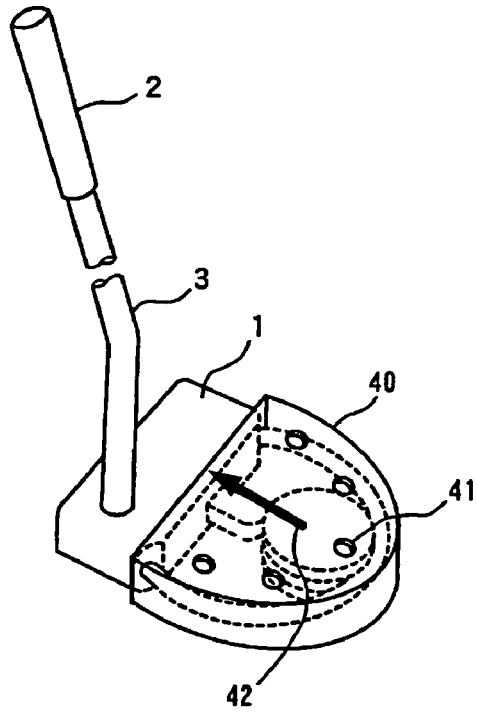
FIG. 9 is a perspective view of a produced example of the putter according to the present invention.
Figure 10:
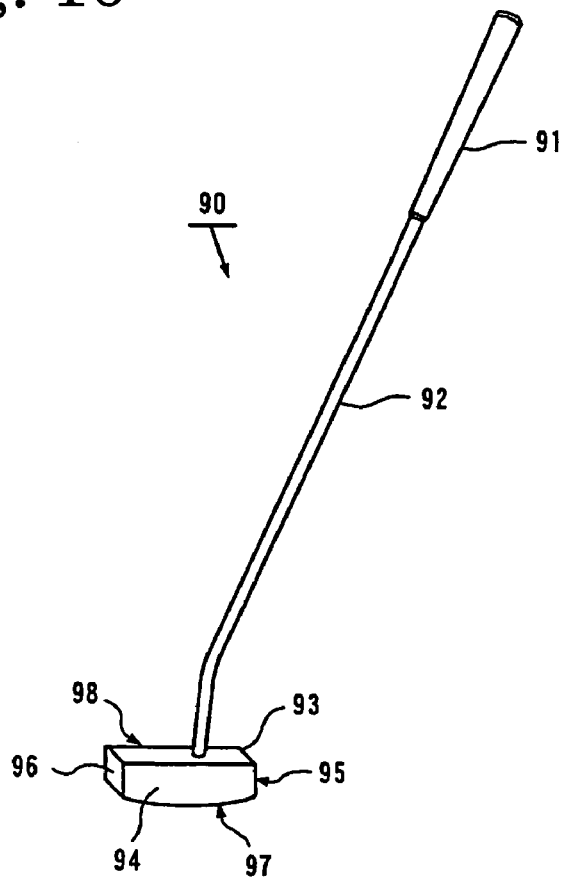
FIG. 10 shows the appearance of an ordinary putter.
Figure 11:
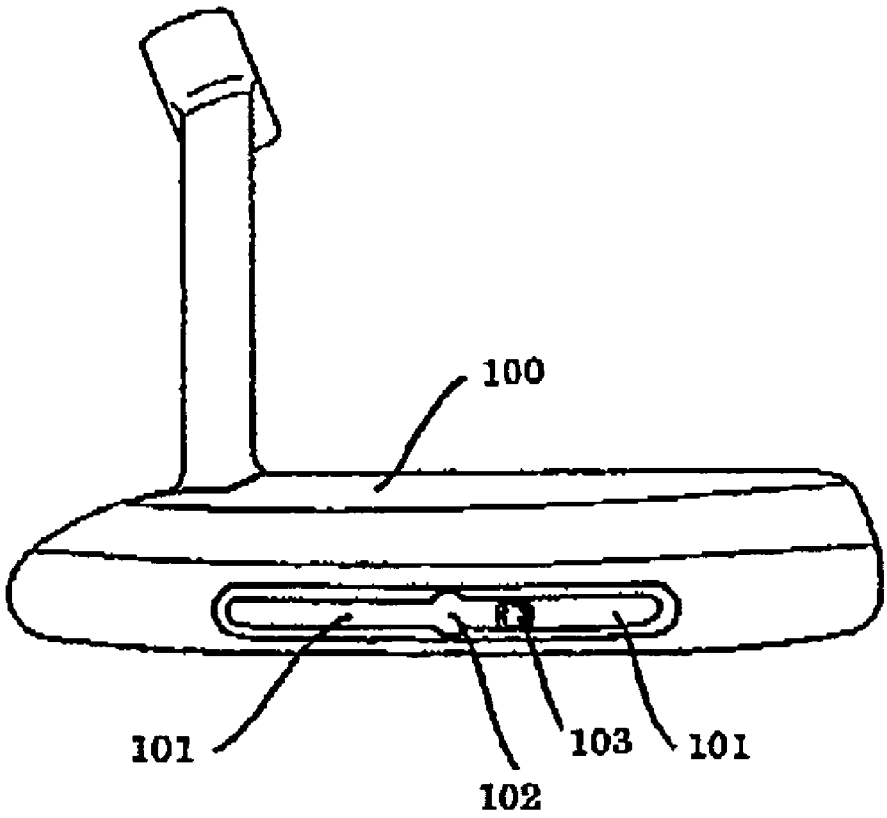
FIG. 11 shows the method of adjusting the head weight and center of gravity in the conventional invention.

FIG. 9 shows a produced example of the putter head according to the present invention.

When a player puts, an environment allowing concentration to the play is important. Consequently, if structures such as the guide 9, the weight 11 and so on provided on the back face 5 of the head 1 are exposed, they may disturb the player's concentration, and, the appearance to the third party is not good.

There, in the present produced example, a cover 40 is attached to the back face 5 of the head 1, a plurality of indication holes 41 are provided on the surface of the cover 40 in order to identify the position of the weight 11 and, at the same time, a mark 42 is provided to indicate the direction of a correct stroke along the central line.

What is claimed is:

1. A golf putter having a head, a shaft having a proximate end connected to the head, and a grip connected to a distal end of the shaft, wherein said head having a face, a toe, a heel, a back face, a ring-shaped or U-shaped guide bar having an outer surface defining an outer perimeter of said guide bar and an inner surface defining an inner perimeter of said guide bar;

wherein a first end and second end of said guide bar are attached to said back face at said toe and heel respectively, a retention body attached to the back face at a center thereof projecting in a direction away from the back face and in the same horizontal plane as said guide bar, a weight comprising an upper and lower portions and having a fixation means for holding the upper and lower portions together;

wherein said weight is positioned between the inner surface of said guide bar and the retention body and is movably retained along an arcuate path created by said guide bar.

2. The golf putter of claim 1 wherein said fixation means comprises a female screw hole provided in said weight and a male screw to engage with said female screw hole, and the head of said male screw has a slot to engage with the thickness of a coin currently in use.

* * * * *